US005916866A

United States Patent [19]

Davies et al.

[11] Patent Number: 5,916,866

[45] Date of Patent: Jun. 29, 1999

[54] PREPARATION OF LAUNDRY DETERGENT TABLETS

[75] Inventors: Alan Phillip Davies, Merseyside; Sara Jane Edwards, Cheshire; Douglas Wraige, Chester, all of United Kingdom

[73] Assignee: Lever Brothers Company, Division of Conopco, Inc., New York, N.Y.

[21] Appl. No.: 08/882,656

[22] Filed: Jun. 25, 1997

Related U.S. Application Data

[63] Continuation of application No. 08/557,975, Nov. 13, 1995, abandoned.

[30] Foreign Application Priority Data

Nov. 14, 1994 [GB] United Kingdom ..... 9422924

[51] Int. Cl.[6] ..... C11D 11/00; C11D 17/00

[52] U.S. Cl. ..... 510/441; 510/294; 510/298; 510/446; 510/475; 510/476; 510/507

[58] Field of Search ..... 510/441, 446, 510/475, 476, 294, 298, 507

[56] References Cited

U.S. PATENT DOCUMENTS

| | | | |
|---|---|---|---|
| 3,081,267 | 3/1963 | Laskey | 252/135 |
| 3,231,505 | 1/1966 | Farrar et al. | 252/138 |
| 3,324,038 | 6/1967 | Chaffee et al. | 252/152 |
| 3,366,570 | 1/1968 | Slob | 252/99 |
| 3,630,920 | 12/1971 | Freifeld et al. | 252/90 |
| 3,951,821 | 4/1976 | Davidson | 252/1 |
| 3,953,350 | 4/1976 | Fujino et al. | 252/94 |
| 3,962,107 | 6/1976 | Levin et al. | 252/100 |
| 4,009,113 | 2/1977 | Green et al. | 510/441 |
| 4,219,435 | 8/1980 | Biard et al. | 252/90 |
| 4,219,436 | 8/1980 | Gromer et al. | 252/135 |
| 4,370,250 | 1/1983 | Joshi | 252/135 |
| 4,446,035 | 5/1984 | Barrat et al. | 510/335 |
| 4,587,031 | 5/1986 | Kruse et al. | 252/135 |
| 4,642,197 | 2/1987 | Kruse et al. | 252/98 |
| 4,767,559 | 8/1988 | Kruse et al. | 510/114 |
| 4,839,078 | 6/1989 | Kruse et al. | 252/99 |
| 5,133,892 | 7/1992 | Chun et al. | 252/90 |
| 5,198,198 | 3/1993 | Gladfelter et al. | 422/264 |
| 5,360,567 | 11/1994 | Fry et al. | 252/90 |
| 5,407,594 | 4/1995 | Fry et al. | 252/90 |
| 5,658,874 | 8/1997 | Davies et al. | 510/446 |
| 5,759,988 | 6/1998 | Heile et al. | 510/441 |

FOREIGN PATENT DOCUMENTS

| | | |
|---|---|---|
| 0 130 639 | 9/1987 | European Pat. Off. . |
| 0 318 204 | 5/1989 | European Pat. Off. . |
| 0 395 333 | 10/1990 | European Pat. Off. . |
| 0 466 484 | 1/1992 | European Pat. Off. . |
| 0 466 485 | 1/1992 | European Pat. Off. . |
| 0 482 627 | 4/1992 | European Pat. Off. . |
| 0482627 | 4/1992 | European Pat. Off. . |
| 481 793 | 4/1992 | European Pat. Off. . |
| 0 508 934 | 10/1992 | European Pat. Off. . |
| 0 522 766 | 1/1993 | European Pat. Off. . |
| 1 290 282 | 3/1969 | Germany . |
| 58-213714 | 12/1983 | Japan . |
| 911 204 | 11/1962 | United Kingdom . |
| 972 239 | 10/1964 | United Kingdom . |
| 983243 | 2/1965 | United Kingdom . |
| 989 683 | 4/1965 | United Kingdom . |
| 1080066 | 8/1967 | United Kingdom . |
| 2021143 | 11/1979 | United Kingdom . |
| WO 90/02165 | 3/1990 | WIPO . |

OTHER PUBLICATIONS

Abstract of JP 60–015500 Jan. 26, 1985.

Abstract of JP 60–135497 Jul. 18, 1985.

Abstract of JP 60–135498 Jul. 18, 1985.

Lowenthal, W. et al., "Disintegration of Tablets", *Journal of Pharmaceutical Sciences*, vol. 61, No. 11, Nov. 1972, pp. 1695–1711.

*Primary Examiner*—Lorna Douyon

*Attorney, Agent, or Firm*—Rimma Mitelman

[57] ABSTRACT

In a process for making detergent tablets comprising spraying a coating of a water-soluble organic polymeric binder onto the exterior of particles of detergent composition containing detergent active and detergency builder and compacting the composition, the improvement comprises spraying an external coating of a film-forming water-soluble organic polymer onto the tablets. The coating on the tablet exterior reduces friability and abrasion and provides extra enhancement of strength while permitting disintegration/dissolution in a wash liquor.

4 Claims, No Drawings

PREPARATION OF LAUNDRY DETERGENT TABLETS

This is a continuation application of Ser. No. 08/557,975, filed Nov. 13, 1995, now abandoned.

FIELD OF THE INVENTION

The present invention relates to detergent compositions in the form of tablets of compacted detergent powder.

BACKGROUND AND PRIOR ART

Detergent compositions in tablet form are known in the art, as discussed below, and some products are now on the market. Tablets have several advantages over powdered products: they do not require measuring and are thus easier to handle and dispense into the washload, and they are more compact, hence facilitating more economical storage.

Detergent tablets are described, for example, in GB 911204 (Unilever), U.S. Pat. No. 3,953,350 (Kao), JP 60-015500A (Lion), JP 60-135497A (Lion) and JP 60-135498A (Lion); and are sold commercially in Spain.

Detergent tablets are generally made by compressing or compacting a detergent powder.

As pointed out in EP-A-522766 (Unilever), difficulty has been encountered in providing tablets which have adequate strength when dry, yet disperse and dissolve quickly when wet.

It has been found that highly compacted tablets which are strong enough to withstand packaging, shipping and handling without crumbling or producing dust do not disperse quickly in a wash liquor, and so do not give efficient cleaning. In some cases a lump of undissolved detergent may remain at the end of the wash cycle. On the other hand a lightly compacted tablet which shows fast dissolution in the wash liquor has poor handling characteristics, being breakable and also friable and producing dust.

There have been proposals to apply a coating to tablets. Thus, GB 983,243 and 989683 (Colgate) describe coating detergent tablets with an aqueous solution of polyvinyl alcohol and glycerol or other plasticisers, and then drying them with forced air, heated air or infra-red rays to harden the coating and evaporate the solvent.

These documents teach that the coating improves resistance to breakage and also gives resistance to abrasion.

EP-A-522766 teaches the use of a water soluble organic polymer as a binder material. This material, applied to the particulate composition before making into tablets, leads to an increase in strength of the tablets. It allows good tablet strength to be achieved, at moderate compaction pressure. The resulting tablets disintegrate quickly in water.

A comparative example in this document showed that the same material could merely be applied to the tablet after the compaction of the binder-free composition. However, the teaching of the document is that it is better to utilise the material as a binder within the tablet.

SUMMARY OF THE INVENTION

When a particulate detergent composition, including a polymeric binder, is compacted to form a tablet, the individual particles remain visible. We have now found that if an external water-soluble coating is applied to such a tablet, the friability of the tablet surface is reduced and resistance to abrasion is increased, although the presence of the coating may not greatly alter the visual appearance of the tablet.

We have found that the presence of an external coating of a water-soluble material does not have a deleterious effect on the disintegration of the tablet as measured by the amount of residue remaining after a period of exposure to water.

In some instances, the presence of an external coating may further enhance the tablet strength. This is beneficial in itself, and may allow tabletting at a reduced compaction force which in turn enhances the speed of disintegration of a tablet.

Accordingly, in a first aspect, this invention provides a tablet of compacted particulate detergent composition comprising detergent active, detergency builder and optionally other detergent ingredients, which particulate composition includes an organic polymeric binder material distributed therein, characterised in that the tablet has an external coating of a water-soluble material.

Preferably this coating provides between 0.5 and 10% of the overall weight of the tablet, better at least 1% e.g. between 1 and 4% or 5%. It is strongly preferred that the coating is a film-forming material.

A preferred coating material is a copolymer of acrylic or methacrylic acid and maleic acid or anhydride. Such a polymer may be used in a form in which any maleic anhydride residues have been hydrolysed and the carboxylic acid groups have been neutralised to salt form. Such copolymers have the advantage that they function as cobuilders with aluminosilicate, and thus perform a useful function in the wash liquor as well as having a benefit in the tablets.

Consequently, in a second aspect this invention provides a tablet of compacted particulate detergent composition comprising detergent active, aluminosilicate detergency builder and optionally other detergent ingredients, characterised in that the tablet has an external coating of a water-soluble copolymer of acrylic or methacrylic acid and maleic acid or anhydride.

This invention also provides the use of a water-soluble coating on detergent tablets to strengthen the tablet surface against abrasion.

DETAILED DESCRIPTION AND EMBODIMENTS

Constituents and features of the tablets will now be discussed in more detail.

Particle Size and Distribution

A detergent tablet of this invention, or a discrete region of such a tablet, is a matrix of compacted particles.

Preferably the particulate composition which is compacted is substantially free of small particles.

More preferably, the composition consists substantially wholly of particles within the size range of 180 to 2000 $\mu$m, desirably at least 200 $\mu$m and still more preferably from 250 to 1400 $\mu$m. It is desirable that not more than 5 wt % of particles should be larger than the upper limit, and not more than 5 wt % should be smaller than the lower limit.

This distribution is different from that of a conventional spray-dried detergent powder. Although the average particle size of such a powder is typically about 300–500 $\mu$m, the particle size distribution will include a "fines" (particles $\leqq$200 $\mu$m) content of 10–30 wt %.

Such a powder may nevertheless be a suitable starting material for a tablet according to the present invention, although it is strongly preferred that fines are eliminated by sieving, before tabletting.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low-bulk-density powder, a given dose of detergent composition can be presented as a smaller tablet.

Thus the starting particulate composition may suitably have a bulk density of at least 400 g/litre, preferably at least 500 g/litre, and advantageously at least 700 g/litre.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Most preferred are granular detergent compositions prepared by granulation and densification in a high-speed mixer/granulator (Fukae mixer), as described in the above-mentioned EP 340013A (Unilever) and EP 425277A (Unilever). With some compositions, this process can produce granular compositions satisfying the criteria of particle size distribution given above, without sieving or other further treatment.

The tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example having layers, inserts or coatings around inserts, some or all of which are derived by compaction from particulate composition(s).

In a heterogeneous tablet, any one or more of the discrete regions may consist essentially of a matrix as defined above. Where two or more such matrices are present in different regions, they may have the same or different particle size ranges: for example, a first region (for example, outer layer) may consist essentially of particles with a relatively wide particle size range (for example, 250 to 1400 $\mu$m) while another (inner core) may consist essentially of particles with a relatively narrow particle range (for example, 500 to 710 $\mu$m).

It is within the scope of the invention for a minor proportion of visually contrasting particles not within the size range of the matrix to be present: the most obvious example of this being the inclusion of a small proportion of much larger particles. In this embodiment of the invention, the visually contrasting particles must be larger in at least one dimension than the matrix particles. The effect of contrast may be enhanced if the non-matrix particles are of a contrasting shape, for example, noodles. Visual contrast may if desire be further emphasised by the use of a contrasting colour.

As previously indicated, it is not necessary for all the particles constituting the matrix to be of identical composition. The particulate starting composition may be a mixture of different components, for example, a spray-dried detergent base powder, surfactant particles, additional builder salts, bleach ingredients and enzyme granules, provided that all satisfy the criteria on particle size.

Binder

The particulate composition must include a binder material. Preferred is that at least some of the particles of the detergent composition are individually coated with the binder material. Then, when the composition is compacted, this coating serves as a binder distributed within the composition. The binder is preferably distributed throughout the tablet, although the invention may be utilised when binder is contained within only a discrete region of the tablet.

It is strongly preferred that the binder is water-soluble and that it serves as a disintegrant by disrupting the structure of the tablet when the tablet is immersed in water, as taught in our EP-A-522766.

Use of a binder helps to hold the tablet together, thus enabling it to be made using a lower compaction pressure and making it inherently more likely to disintegrate well in the wash liquor. If the binder is also a material that causes disruption when contacted with water, even better disintegration properties may be achieved.

It is preferred that the binder material should melt at a temperature of at least 35° C., better 40° C. or above, which is above ambient temperatures in many temperate countries.

For use in hotter countries it will be preferable that the melting temperature is somewhat above 40° C., so as to be above the ambient temperature.

For convenience the melting temperature of the binder material should desirably not be above 80° C.

Preferred binder materials are synthetic organic polymers of appropriate melting temperature, especially polyethylene glycol. Polyethylene glycol of average molecular weight 1500 (PEG 1500) melts at 45° C. and has proved suitable. Polyethylene glycol of higher molecular weight can also be used.

Other possibilities are polyvinylpyrrolidone, and polyacrylates and water-soluble acrylate copolymers.

The binder may suitably be applied to the particles by spraying, e.g. as a solution or dispersion. The binder is preferably used in an amount within the range from 0.1 to 10% by weight of the tablet composition, more preferably at least 1% better at least 3%. It is preferred that the amount is not more than 8% or even 6%.

Detergent-active Compounds

The total amount of detergent-active material in the tablet of the invention is suitably from 2 to 50 wt %, and is preferably from 5% or 9% up to 40 wt %. Detergent-active material present may be anionic (soap or non-soap), cationic, zwitterionic, amphoteric, nonionic or any combination of these.

Anionic detergent-active compounds may be present in an amount of from 0.5 to 40 wt %, possibly from 2 or 4 wt % upwards. The amount may well be no more than 30 wt %.

Synthetic (i.e.non-soap) anionic surfactants are well known to those skilled in the art. Examples include alkylbenzene sulphonates, particularly sodium linear alkylbenzene sulphonates having an alkyl chain length of $C_8$–$C_{15}$; primary alcohol sulphates more usually known as primary alkyl sulphates; olefin sulphonates; alkane sulphonates; dialkyl sulphosuccinates; and fatty acid ester sulphonates.

Primary alkyl sulphate having the formula $$ROSO_3^-M^+$$

in which R is an alkyl or alkenyl chain of 8 to 18 carbon atoms, especially 10 to 14 carbon atoms and $M^+$ is a solubilising cation is commercially significant as an anionic detergent active. It is frequently the desired anionic detergent and may provide 75 to 100% of any anionic non-soap detergent in the composition.

In some forms of this invention the amount of non-soap anionic detergent lies in a range from 0.5 to 15 wt % of the tablet composition.

It may also be desirable to include one of more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide ether alone or with propylene oxide.

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine. Other so-called nonionic detergent compounds include long-chain amine oxides, tertiary phosphine oxides, and dialkyl sulphoxides.

Especially preferred are the primary and secondary alcohol ethoxylates, especially the $C_{12-15}$ primary and secondary alcohols ethoxylated with an average of from 5 to 20 moles of ethylene oxide per mole of alcohol.

In certain forms of this invention the amount of non-ionic detergent lies in a range from 4 to 40%, better 4 or 5 to 30% by weight of the composition.

The nonionic detergent-active compounds may be concentrated in discrete domains. Since the nonionic detergent compounds are generally liquids, these domains are preferably formed from a porous solid carrier impregnated by nonionic detergent-active compound. Preferred carriers include zeolite, sodium perborate monohydrate and Burkeite (spray-dried sodium carbonate and sodium sulphate as disclosed in EP 221776 (Unilever)).

Nonionic detergent-active compounds may optionally be mixed with materials which make such granules slow wetting and/or prevent the nonionic detergent leaching out into the main tablet matrix. Such materials may suitably be fatty acids, especially lauric acid.

The present invention may be applied with compositions which contain more nonionic detergent than non-soap anionic detergent (if any). In compositions of such character, we have found that a weight ratio of nonionic detergent to non-soap anionic detergent in the range 95:5 to 80:20 has been found to give faster dissolution of tablets than does a mixture with a greater proportion of the anionic detergent.

Detergency Builders

The detergent tablets of the invention contain one or more detergency builders, suitably in an amount of from 5 to 80 wt %, preferably from 15 or 20 to 80 wt %.

The invention is of especial relevance to tablets derived from detergent compositions containing alkali metal aluminosilicates as builders, since such tablets appear to have a particular tendency to exhibit disintegration and dispersion problems.

Alkali metal (preferably sodium) aluminosilicates may suitably be incorporated in amounts of from 5 to 60% by weight (anhydrous basis) of the composition, and may be either crystalline or amorphous of mixtures thereof, having the general formula:

$$0.8\text{–}1.5\ Na_2O.Al_2O_3.\ 0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Proctor & Gamble). The preferred sodium aluminosilicates of this type are the well known commercially available zeolites A and X, and mixtures thereof. Also of interest is the novel zeolite P described and claimed in EP 384070 (Unilever).

Other builders may also be included in the detergent tablet of the invention as necessary or desired. Water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphorates, monomeric polycarboxylates such as citrates, gluconates, oxydisuccinates, glycerol mono- di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15 wt %, especially from 1 to 10 wt %; and monomeric polycarboxylates, more especially citric acid and its salts, suitably used in amounts of from 3 to 20 wt %, more preferably from 5 to 15 wt %.

Preferred tabletted compositions of the invention preferably do not contain more than 5 wt % of inorganic phosphate builders, and are desirably substantially free of phosphate builders. However, phosphate-built tabletted compositions are also within the scope of the invention.

Other Ingredients of the Composition

Preferred tabletted detergent compositions according to the invention suitably contain alkaline material, e.g. 10–20 wt % sodium carbonate, in order to achieve a desired pH of greater than 9.

Tabletted detergent compositions according to the invention may also contain a bleach system. This preferably comprises one or more peroxy bleach compounds, for example, inorganic persalts or organic peroxyacids, which may be employed in conjunction with activators to improve bleaching action at low wash temperatures. It any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included in the detergent tablet of the invention, especially if the tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

In the detergent tablet of the invention, an amount of an alkali metal silicate, particularly sodium ortho-, meta- or preferably alkali metal silicates at levels, for example, of 0.1 to 10 wt %, may be advantageous in providing protection against the corrosion of metal parts in washing machines.

Effervescent disintegrants may be incorporated in the tablet composition. This category of materials includes weak acids or acid salts, for example, citric acid, maleic acid or tartaric acid, in combination with alkali metal carbonate or bicarbonates; these may suitably be used in an amount of from 1 to 25 wt %, preferably from 5 to 15 wt %. Further examples of acid and carbonate sources and other effervescent systems may be found in Pharmaceutical Dosage Forms: Tablets, Volume 1, 1989, pages 287–291 (Marcel Dekker Inc. ISBN 0-8247-8044-2).

Further ingredients which can optionally be employed in the detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; pigments, colorants or coloured speckles; and inorganic salts such as sodium and magnesium sulphate. Sodium sulphate may if desired be present as a filler material in amounts up to 40% by weight of the composition; however as little as 10% or less by weight of the composition of sodium sulphate, or even none at all, may be present.

As well as the functional detergent ingredients listed above, there may be present various ingredients specifically to aid tabletting. Binders and disintegrants have already been discussed. Tablet lubricants include calcium, magnesium and zinc soaps (especially stearates), talc, glyceryl behapate, Myvatex (Trade Mark) TL ex Eastman Kodak, sodium benzoate, sodium acetate, polyethylene glycols, and colloidal silicas (for example, Alusil (Trade Mark) ex Crosfield Chemicals Ltd).

Product Character

The detergent tablet of the invention may be, and preferably is, formulated for use as a complete heavy-duty fabric washing composition. The consumer then does not need to use a mix of tablets having different compositions.

Although one tablet may contain sufficient of every component to provide the correct amount required for an average washload, it is convenient if each tablet contains a submultiple quantity of the composition required for average washing conditions, so that the consumer may vary the dosage according to the size and nature of the washload. For example, tablet sizes may be chosen such that two tablets are sufficient for an average washload; one or more further tablets may be added if the washload is particularly large of soiled; and one only tablet may be used if the load is small or only lightly soiled.

Alternatively, larger subdivisible tablets representing a single or multiple dose may be provided with scorings or indentations to indicate unit does or submultiple unit dose size to the consumer and to provide a weak point to assist the consumer in breaking the tablet is appropriate.

The size of a single tablet will suitably range from 10 to 160 gram, preferably from 15 to 60 gram, depending on the conditions of intended use, and whether it represents a dose for an average wash load, or a submultiple of such a dose.

The tablets may be of any shape. However, for ease of packaging they are preferably blocks of substantially uniform cross-section, such as cylinders or cuboids.

Tabletting

Tabletting entails compaction of a particulate composition. A variety of tabletting machinery is known, and can be used. Generally it will function by stamping a quantity of the particulate composition which is confined in a die.

For any given starting composition, the compaction pressure which is used to form the tablets will affect both the strength of the tablets and the length of time for them to disintegrate when put into water. Preferably the temperature of tabletting is above ambient, but below the melting temperature of the polymeric binder. Raising the temperature of tabletting allows adequate strength to be achieved with lesser compaction pressures—which generally leads to more porous tablets which disintegrate more quickly, and may also reduce the cost of the tabletting machinery.

In order to carry out the tabletting at the temperature which is above ambient, the particulate composition is preferably supplied to the tabletting machinery at an elevated temperature. This will of course supply heat to the tabletting machinery, but the machinery may be heated in some other way also.

For production scale machinery it may be desirable to construct the mould in which tabletting occurs so that it incorporates channels for the circulation of liquid at the desired temperature. Alternatively the mould could be surrounded by an electric heating coil, controlled by a temperature sensor in contact with the mould.

The temperature of the particulate composition delivered to the tabletting machinery may be regulated by conveying the composition through a tunnel which is heated to the temperature chosen for tabletting.

Preparation of the composition may itself generate heat and this may serve to bring the composition to the desired temperature for tabletting.

Coating Materials and Application

Materials used as an outer coating on tablets should be capable of forming a continuous layer which is not friable and preferably is smooth to touch. They must be water-soluble. It is strongly preferred that they are film-forming materials.

Materials discussed above as water-soluble binders, notably film-forming water-soluble organic polymers melting between 40 and 80° C. may be used to provide a coating.

Such polymers can be applied in their molten state, and allowed to cool and solidify on the tablets. Dipping the tablets into molten polymer is one possible method of application although it tends to give a rather thick coating. Spraying on of molten polymer is possible. A polymer can also be sprayed on as a solution, e.g. in organic solvent.

As mentioned above, one preferred coating material is a copolymer of acylic or methacrylic acid and maleic acid or anhydride. Such a polymer may be used in a neutralised form containing acrylate (or methacrylate) and maleate.

Other materials able to form coating films include sugars, which may be applied as concentrated aqueous solutions and allowed to dry. A solution of a sugar which is applied as a coating may have a concentration of at least 25% by weight, better at least 40% by weight.

Machinery for the coating of articles on an industrial scale is available and can be applied to the coating of tablets. The machinery may be such as is used in the food and confectionary industries for the application of edible coatings. One supplier of such machinery, which applies the coating material as sprays, is APV Baker, Peterborough, England.

TESTING

A measure of the strength of tablets is their diametral fracture stress σ calculated from the equation $$\sigma = \frac{2P}{\pi D t}$$

where σ is the diametral fracture stress in Pascals, P is the applied load in Newtons to cause fracture, D is the tablet diameter in metres and t is the tablet thickness in metres.

Tablets of the invention preferably have a diametral fracture stress of at least 5 kPa, and more preferably at least 7 kPa.

The speed of disintegration of a detergent tablet can be assessed by means of the following test The tablet is weighed, placed in a cage of perforated metal gauze (9 cm×4.5 cm×2 cm) having 16 apertures (each about 2.5 mm square) per $cm^2$. The cage is suspended in a beaker of demineralised water at 20° C. and rotated at 80 rpm. The time taken for the tablet to disintegrate and fall through the gauze (the disintegration time) is recorded (or after chosen period, e.g. 10 minutes, if the tablet has not wholly disintegrated the residue is determined by weighing after drying).

It will be appreciated that this is a very stringent test, since water temperature and agitation are both much lower than in a real wash situation in a machine with a washload present. Disintegration times under real wash conditions are expected to be shorter.

EXAMPLE 1

Tablets were prepared with each of the following formulations:

| | % by weight | |
|---|---|---|
| Composition No: | 1 | 2 |
| Granulated Components | | |
| coconut primary alkyl sulphate | 5.7 | 1.52 |
| coconut alcohol 3EO | — | 8.22 |
| coconut alcohol 6EO | — | 5.47 |
| $C_9$-$C_{11}$ alcohol 6EO | 8.6 | — |
| zeolite* | 31.2 | 34.9 |
| sodium carbonate | 14.6 | — |
| soap | — | 3.56 |
| Sodium Carboxymethyl Cellulose | 0.5 | 1.16 |

-continued

| | % by weight | |
|---|---|---|
| Composition No: | 1 | 2 |
| fluorescer | 0.2 | 0.25 |
| water | 9.5 | 6.91 |
| Postdosed Components | | |
| PEG 1500 | 4.8 | 4.54 |
| sodium perborate | 14.0 | 20.88 |
| TAED granule | 7.4 | 4.47 |
| perfume | 0.5 | 0.6 |
| antifoam | 3.0 | — |
| sodium disilicate | — | 4.47 |

*Quoted as amounts of anhydrous material. Water of crystallisation is included in the water content.

The production procedure was as follows. The materials listed as "granulated components" were mixed in a Fukae (Trade Mark) FS-100 high speed mixer-granulator. The soap was prepared in situ by neutralisation of fatty acid. The mixture was granulated and densified to give a powder of bulk density greater than 800 gm/litre and a mean particle size of approximately 650 μm.

The powder was sieved to remove fine particles smaller than 180 μm and large particles exceeding 1700 μm. The remaining solids were then mixed with the powder in a rotary mixer, after which the perfume was sprayed on, followed by the PEG. The PEG was sprayed at about 80° C. with the powder at 35 to 40° C.

TABLET PREPARATION

Detergent tablets were prepared by compaction of 50 g quantities of the detergent powder formulations at compaction pressure sufficient to produce a diametral fracture stress of at least 5 kPa. The actual values obtained are shown below. The tablets were produced using an Instron Universal Testing Machine to drive a cylindrical steel punch into a cylindrical die. The tablets were of circular cross-section having a diameter of 4.5 cm and a thickness of approximately 1 cm.

Some of the tablets were coated with PEG 1500, applied as a spray, using an Arcall 655 spray unit available from APV Baker, Peterborough, England.

The PEG 1500 coating material was sprayed on at a temperature of about 75° C., in quantities such that the coating was a few percent of the total tablet weight.

The strength of the tablets was measured some time after coating—15 hours in the case of composition 1, 4 days in the case of composition 2. The results were:

| | DFS (kPa) |
|---|---|
| Composition 1 | |
| Uncoated | 15.2 |
| 2% coating | 25.1 |
| 4% coating | 30.3 |
| Composition 2 | |
| Uncoated | 11.2 |
| 2% coating | 14.8 |
| 5.5% coating | 15.6 |

EXAMPLE 2

A granular powder composition was prepared using the same procedure as in the previous example. Composition of this powder was:

| | % by weight |
|---|---|
| Granulated Components | |
| coconut primary alkyl sulphate | 4.5 |
| $C_9$-$C_{11}$ alcohol 6EO | 11.3 |
| zeolite* | 26.5 |
| sodium carbonate | 0.9 |
| soap | 1.7 |
| Sodium Carboxymethyl Cellulose | 0.7 |
| water | 5.2 |
| Postdosed Components | |
| PEG 1500 | 4.8 |
| sodium perborate tetra hydrate | 15.5 |
| TAED granule | 3.3 |
| perfume | 0.6 |
| antifoam | 2.7 |
| sodium disilicate | 3.3 |
| Sodium citrate | 20.0 |

*Quoted as amounts of anhydrous material. Water of crystallisation is included in the water content.

The granular powder was compacted into tablets using various levels of compaction force. Some of the tablets were spray coated with either sucrose or a water-soluble copolymer of vinyl pyrrolidone (30 wt %) and vinyl acetate (70 wt %) available as Luviskol 37 E from BASF. The sucrose was sprayed on as a 50% by weight aqueous solution. The copolymer was sprayed on as a 20% solution in ethanol. After spraying on of the coatings, the coated tablets were allowed to dry at room temperature.

Some of the tablets were tested for diametral fracture stress and disintegration in water by the procedures quoted earlier.

| Compaction Force (KN) | Coating | DFS (KPa) | Residue (% wt) after ten min. |
|---|---|---|---|
| 0.25 | Uncoated | 7.1 | |
| 0.25 | 1% Copolymer | 14.6 | 15.1 |
| 0.5 | Uncoated | 15.8 | 22.8 |
| 0.5 | 1% Copolymer | 20.3 | |
| 0.5 | 2% Copolymer | 23.2 | |
| 0.5 | 1% Sucrose | 15.9 | 21.1 |
| 0.5 | 2.8% Sucrose | 15.4 | |
| 0.5 | 2% Copolymer | 23.2 | |
| 1.0 | Uncoated | 20.2 | |
| 1.0 | 1.3% Copolymer | 35.2 | |

As can be seen from the results in the above table coating with sucrose has no adverse effect on either the tablets strength or the speed of disintegration in water. Coating with the polymer leads to an increase in tablet strength. The residue from disintegration of the tablets with a 1% polymer coating made at a compaction force of 0.25 kn was slightly less than that from the uncoated tablets of similar strength made with a compaction force of 0.5 kn.

A number of tablets made at 0.5 kn compaction force were tested for friability by means of a test in which a standard length of adhesive tape is applied to the tablets, then removed and weighed to determine the amount of tablet composition which has been pulled off the tablets and onto the adhesive tape. The results were as follows

| Coating | Weight Removed (g) |
|---|---|
| Uncoated | 0.13 |
| 1% copolymer | 0.01 |
| 2% Copolymer | 0.01 |
| 1% Sucrose | 0.01 |
| 2% Sucrose | 0.02 |

It will be appreciated from the figures quoted in the above table that the weight of material removed from the coated tablets onto the adhesive tape was much less than the weight removed from the uncoated tablets. This effect was conspicuously visible as the test was carried out. The adhesive removed from the uncoated tablets carried on it an obvious coating of white powder removed from the tablets. Adhesive tape removed from any of the coated tablets had very little powder on it.

EXAMPLE 3

A further powder composition was prepared using the same procedure as in Example 1. Composition of this powder was:

| | Parts by weight |
|---|---|
| Granulated Components | |
| coconut primary alkyl sulphate | 1.33 |
| coconut alcohol 5EO | 11.94 |
| zeolite | 29.13 |
| soap | 3.12 |
| water | 5.0 |
| Postdosed Components | |
| PEG 1500 | 5.0 |
| Sodium carboxymethyl cellulose | 0.8 |
| sodium perborate tetrahydrate | 19.5 |
| TAED granule | 4.2 |
| antifoam | 3.4 |
| sodium citrate | 15.0 |
| perfume and other minor ingredients | 1.6 |

The PEG 1500 was melted and sprayed onto the granular powder. The powder was then compacted into tablets. This was done using a commercial tabletting machine. After a few hours, some of the tablets were spray-coated with a 30% w/v aqueous solution of a copolymer of acrylate and maleate (70:30 ratio, average molecular weight 70,000) available as Alcosperse 175D from National Starch. This polymer solution was applied in sufficient quantity that the resulting polymer coating on the tablet surface constituted 1.5% by weight of the tablets. After coating, the tablets were allowed to dry.

The diametral fracture stress of coated and uncoated tablets was tested by the procedure quoted earlier. The experiment was repeated several times, using a different batch of powder each time and with differing settings of the tabletting machine. For one of the powder batches, the disintegration of the tablets in water was also tested by the procedure given earlier, noting the undissolved tablet residue after 3, 5 and/or 10 minutes. The results are set out in the following two tables.

| Powder | Tablet DFS (KPa) uncoated | coated |
|---|---|---|
| Batch 1 | 5.0 | 11.0 |
| Batch 2 | 5.2 | 11.2 |
| Batch 3 | 2.5 | 11.2 |
| Batch 4 | 4.0 | 7.8 |

| Powder Batch 1 | cage residue (wt %) after 3 minutes | 5 minutes | 10 minutes |
|---|---|---|---|
| uncoated | | 10.6 | 0 |
| coated | 0 | 0 | 0 |

In addition, a portion of powder from each batch was tabletted at greater pressure, making uncoated tablets with a strength almost as great as the coated tablets shown in the tables above. These tablets were observed to have higher density, and therefore to show less porosity when placed in water, compared to the coated tablets, even though the coated tablets were slightly stronger.

EXAMPLE 4

The previous example was repeated, using the following powder formulation which contained alkyl benzene sulphonate as the detergent active, and did not include any PEG 1500.

| | Parts by weight |
|---|---|
| Granulated Components | |
| linear alkyl benzene sulphonate | 8.1 |
| coconut alcohol 5EO | 5.4 |
| zeolite | 24.4 |
| soap | 5.0 |
| water | 8.8 |
| Postdosed Components | |
| Sodium carboxymethyl cellulose | 0.8 |
| sodium perborate tetrahydrate | 19.5 |
| TAED granule | 4.4 |
| antifoam | 3.8 |
| sodium citrate | 15.6 |
| perfume and other minor ingredients | 1.6 |

The results obtained are shown in the following two tables.

| Powder | Tablet DFS (kPa) uncoated | coated |
|---|---|---|
| Batch 1 | 3.0 | 7.8 |
| Batch 2 | 5.8 | 11.0 |
| Batch 3 | 5.3 | 14.8 |
| Batch 4 | 5.0 | 14.0 |

-continued

| Powder Batch 1 | cage residue (wt %) after 5 minutes | 10 minutes |
|---|---|---|
| uncoated | 28.2 | 12.0 |
| coated | 22.7 | 2.4 |

Thus, the tablets with the coating had greater strength and faster dissolution.

As in the previous example, a portion of powder from each batch was tabletted at greater pressure, making uncoated tablets with a strength almost as great as the coated tablets shown in the tables above. These tablets were observed to have higher density, and therefore to show less porosity when placed in water, compared to the (slightly stronger) coated tablets.

The tablet strength could be further enhanced, if desired, by drying the powder after it had been made and then (as in the previous examples) spraying a binder material onto the powder before making the tablets.

We claim:

1. In a process for making tablets of compacted particulate laundry detergent composition for fabric washing comprising the steps of:

spraying a coating of polyethylene glycol which is a water-soluble organic polymeric binder which melts at a temperature in the range from 35° C. to 80° C. onto the exterior of particles of a particulate detergent composition which particles contain from 2% to 50% by weight of a detergent active selected from the group consisting of anionic, cationic, nonionic, zwitterionic and amphoteric detergent active compounds and mixtures thereof and from 15% to 60% by weight of aluminosilicate detergency builder, said particles having a particle size in the range from 250 to 1400 $\mu$, and thereafter compacting said composition with said binder on the exterior of said particles into tablets in which said particles and binder thereon are distributed within at least a region of the tablet;

the improvement which comprises spraying onto said tablets an external coating of a film-forming water-soluble organic polymer selected from the group consisting of polyethylene glycol, copolymer of vinylpyrrolidone and vinyl acetate, and copolymer of maleate and acrylate; wherein said external coating provides between 1 and 10% of overall weight of the tablet.

2. A process according to claim 1 wherein said tablet comprises: from 5% to 40% by weight of said detergent-active, at least 20% by weight of said aluminosilacate detergency builder, and from 1% to 8% by weight of said water-soluble organic polymeric binder.

3. A process according to claim 2 wherein the tablet contains at least 9% by weight of detergent active.

4. A process according to claim 1 wherein the binder is present in an amount from 3% to 6% by weight of the tablet.

* * * * *